US006513575B1

(12) United States Patent
Svahn et al.

(10) Patent No.: US 6,513,575 B1
(45) Date of Patent: Feb. 4, 2003

(54) METHOD AND DEVICE FOR CONTINUOUS CASTING OF METALS

(75) Inventors: Conny Svahn, Västerås (SE); Tord Kroon, Västerås (SE); Jan-Erik Eriksson, Västerås (SE); Göte Tallbäck, Västerås (SE)

(73) Assignee: ABB AB, Vasteras (SE)

( * ) Notice: Subject to any disclaimer, the term of this patent is extended or adjusted under 35 U.S.C. 154(b) by 0 days.

(21) Appl. No.: 09/856,160

(22) PCT Filed: Nov. 2, 1999

(86) PCT No.: PCT/SE99/01967

§ 371 (c)(1),
(2), (4) Date: Jun. 1, 2001

(87) PCT Pub. No.: WO00/32333

PCT Pub. Date: Jun. 8, 2000

(30) Foreign Application Priority Data

Dec. 1, 1998 (SE) ..... 98041395

(51) Int. Cl.[7] ..... B22D 27/02
(52) U.S. Cl. ..... 164/466; 164/502
(58) Field of Search ..... 164/466, 468, 164/502, 504

(56) References Cited

U.S. PATENT DOCUMENTS 5,265,665 A * 11/1993 Fujii et al. ..... 164/453
5,562,152 A * 10/1996 Gerber et al. ..... 164/428
5,722,480 A * 3/1998 Asai et al. ..... 164/466
5,746,268 A * 5/1998 Fujisaki et al. ..... 164/468

FOREIGN PATENT DOCUMENTS

JP 61193755 A * 8/1986
JP 405154620 A * 6/1993
JP 405154623 A * 6/1993
JP 410305353 A * 11/1998
WO WO-97/17151 * 5/1997

OTHER PUBLICATIONS

Patent Abstracts of Japan, JP 10–305353, Nov. 17, 1998.

* cited by examiner

*Primary Examiner*—M. Alexandra Elve
*Assistant Examiner*—Kevin McHenry
(74) *Attorney, Agent, or Firm*—Oblon, Spivak, McClelland, Maier & Neustadt, P.C.

(57) ABSTRACT

A method and a device for continuous casting of metals, in which the device comprises a mould (1), through which a liquid metal passes, and a member (4), through which a liquid metal is supplied as a jet to the mould (1). The device comprises magnet members (6, 7) for applying a magnetic field varying with time and being substantially fixed in the room to the liquid metal in the mould (1).

11 Claims, 5 Drawing Sheets

METHOD AND DEVICE FOR CONTINUOUS CASTING OF METALS

BACKGROUND OF THE INVENTION AND PRIOR ART

The present invention relates to a method for continuous casting of metals, in which a liquid metal is supplied as a jet to a mould, which already contains further liquid metal. The invention also relates to a device for continuous casting of metals, comprising a mould, through which a liquid metal passes, and a member through which a liquid metal is supplied as a jet to the mould, in which there is already liquid metal.

In continuous casting a liquid metal is supplied to a mould, in which it is cooled and shaped to an elongated string. Depending upon the cross section dimensions the string is called "billet", "bloom" or "slab". A primary flow of hot, liquid metal is during the casting delivered to a cooled mould, in which a metal is cooled and at least partially solidifies into an elongated string. The cooled and partially solidified string leaves the mould continuously. At the point where the string leaves the mould it has at least a mechanically self-supporting solidified skin surrounding a centre part not solidified. The cooled mould is open at two opposite ends as seen in the casting direction and preferably connected to means for supporting the mould and means for supplying cooling means to the mould and the support means. The mould is preferably made of an alloy with a copper base and a high thermal conductivity.

The liquid metal is supplied to the mould from a casting box through a tube extending down into the mould. The tube extends preferably that far into the mould that it projects into the liquid metal preferably present there. When the liquid metal from the tube flows into the liquid metal already present in the mould, it generates a so-called primary flow and a so-called secondary flow. The primary flow goes downwardly in the casting direction, while the secondary flow goes from the region of the walls of the mould upwardly towards the surface of the metal bath located therein and downwardly. In different parts of the metal bath present in the mould periodic velocity oscillations are created during the casting sequence. Thus, upper and lower loops in which the liquid metal flows around are formed in a way known per se. As a consequence of resonance phenomena, which are associated with periodical oscillations of such loops, large bubbles, for instance argon bubbles, oxide enclosures from the casting tube and slag from the meniscus will be transported far downwardly in the casting direction, i.e. far downwardly in the casting string initially formed in the mould. This results in enclosures and irregularities in the final, solidified casting string.

Velocity variations caused by oscillating flow in the mould gives rise to pressure variations at the meniscus, and meniscus height variations. At high meniscus velocities, this results in (a) draw-down of slag, (b) uneven slag thickness, (c) uneven skin thickness, and (d) a risk of crack formation.

Furthermore, the oscillating flow results in an asymmetric velocity downwardly in the mould. The velocity may in some positions at one narrow side get substantially higher than at the other. This gives rise to a strong transport downwardly of enclosures and gas bubbles accompanied by a decreased slag quality.

The prior art relates to different devices and methods for influencing the primary and the secondary flows, respectively, in the liquid metal in the mould. The prior art utilizes for this devices for applying substantially static magnetic fields during the casting sequence over at least a part of the liquid metal contained in the mould. It is for instance known through the Swedish patent publication SE 436 251 to arrange a static direct current magnetic field or permanent magnetic field at the mould. It may as an a alternative be formed by a low frequency alternating current field having a frequency below 1 Hz. When the metal flowing in passes this field the movement of the tap jet into the rest of the liquid metal is retarded, wherethrough the flow picture is influenced favourably for the casting sequence. This technique has then been further developed. The magnets used for the generation of the magnetic field have for example been placed so that a magnetic field at different levels of the mould in the casting direction has been obtained, whereby specific local movements in the liquid metal could be influenced separately through the respective magnetic field. It has also been proposed to arrange the magnets and the yokes connecting them in such a way that the magnetic fields extend in the casting direction in stead of transversely thereto.

SUMMARY OF THE INVENTION

An object of the present invention is to provide a method substantially disturbing and thereby reducing the generation of periodical oscillations and resonance phenomena associated therewith, which are commonly existing in a liquid metal in a mould in connection with continuous casting of metals.

This object is obtained by means of a method of the type defined in the introduction, which is characterized in that a magnetic field varying with time and being substantially fixed in the room is applied by means of magnet members to the liquid metal in the mould for preventing natural oscillations of the liquid metal from being generated. The field will function as a damper in the liquid metal.

According to a preferred embodiment of the method the application of the magnetic field is carried out periodically. The periodicity may be adapted to the periodicity of the oscillations, which normally for casting steel slabs is in the order of 1–30 seconds. The field is applied periodically for disturbing and eliminating oscillations in the liquid metal without changing the main flow topology therefor. The flow topology may be changed, for example by means of strong, static magnetic field or a moving field.

According to a further preferred embodiment of the method the varying magnetic field is applied at irregular intervals during the casting sequence. Thanks to the irregularity of the application it is avoided to regularly amplify certain regular, periodical oscillations in the liquid metal. The varying magnetic field causes instead thanks to the regularity thereof a disturbance of such regular natural oscillations in the liquid metal.

According to a further preferred embodiment the irregular application of the magnetic field is carried out at random times. The magnetic field applied randomly counteracts and disturbs efficiently the generation of periodical oscillations. The random application of the magnetic field results in a minimum risk of possibly amplifying any natural oscillation present in the liquid metal during any extended time.

According to an alternative embodiment of the method the periodical application of the magnetic field is carried out at predetermined times. These times are preferably times known in advance, at which periodical oscillations in the liquid metal are in a certain critical stage, for instance when resonance phenomena caused by said natural oscillations start or may start to occur. The predetermined times are then based on practical observations or calculations of the time for the occurrence of such critical stages in the liquid metal under given casting conditions or measurements of meniscus deformation.

According to a further preferred embodiment of the method the application is carried out upon detection of a certain state in the liquid metal. Said state is preferably a predetermined detectable movement in the liquid metal or as an alternative of the meniscus.

According to a further preferred embodiment the varying magnetic field is provided with a stochastically varying amplitude. The probability for disturbing and not amplifying the natural oscillations generated in the liquid metal during the casting sequence is thereby increased.

According to a further preferred embodiment the varying magnetic field is given a frequency being in the order of $10–10^3$ times higher than the frequency of the oscillation or oscillations in the melt intended to be disturbed thereby. These are normally of the type wide-band spectrum. A very reliable disturbance of said oscillations of the liquid metal is thereby obtained. The magnetic field may then advantageously be applied only during a restricted part of the period of the oscillation or oscillations and nevertheless give a satisfying and reliable disturbance influence.

A further object of the invention is to provide a device, by means of which natural oscillations and resonance phenomena associated therewith of a liquid metal in the mould during continuous casting of metals may be disturbed and prevented from being generated.

This object is obtained by means of a device of the type defined in the introduction, which is characterized in that it comprises magnet members for applying a magnetic field varying with time and being substantially fixed in the room to the liquid metal in the mould. Thanks to the fact that the magnetic field varies it may easily be controlled, i.e. be given such an amplitude and frequency, that the periodical oscillations existing or generated in the liquid metal are efficiently disturbed.

According to a preferred embodiment the magnet members are arranged in such a way that they generate the varying magnetic field periodically during the casting sequence. The periodicity is advantageously adapted to the periodicity of the oscillations, which is in the order of 1–30 seconds when casting steel slabs.

According to a further preferred embodiment the magnetic members are adapted to generate the varying magnetic field at irregular intervals. This disturbs efficiently a generation of each natural oscillation, since they will with a high probability be in off-phase with the periodical oscillations existing in the liquid metal.

According to a further preferred embodiment the magnet members are adapted to generate a magnetic field having a stochastically varying amplitude. They are preferably also adapted to generate a magnetic field having a varying frequency, for example stochastically varying frequency, within a given frequency interval. Thanks to the variation of the amplitude and/or frequency of the magnetic field, or the current used to generate the magnetic field, a very reliable disturbance of the natural oscillations in the liquid metal is obtained, at the same time as an amplification of possibly natural oscillations in the liquid metal are efficiently avoided.

According to a further preferred embodiment the magnet members are adapted to generate a substantially static magnetic field, onto which the varying magnetic field is superposed. The static magnetic field is preferably used for influencing the so-called primary flows and secondary flows in the liquid metal in the mould, which the liquid metal supplied thereto gives rise to. The same type of basic equipment, which has according to the prior art been used for achieving such an influence, may accordingly advantageously be used for the combined function aimed at, since both a static magnetic field and varying magnetic field superposed thereon are applied to the liquid metal in the mould.

According to a further preferred embodiment of the device the varying magnetic field has a frequency in the order of $10–10^3$ times higher than the frequency of the oscillation or the oscillations of the liquid metal to be disturbed thereby. A very reliable disturbance of the natural oscillations in the liquid metal is thereby obtained.

Further characteristics and advantages of the invention appear from the other dependent claims and the following detailed description.

BRIEF DESCRIPTION OF THE DRAWINGS

The present invention will hereinafter be described as an example with reference to the appended drawings.

In the drawings.

DETAILED DESCRIPTION OF PREFERRED EMBODIMENTS

Figure 1:
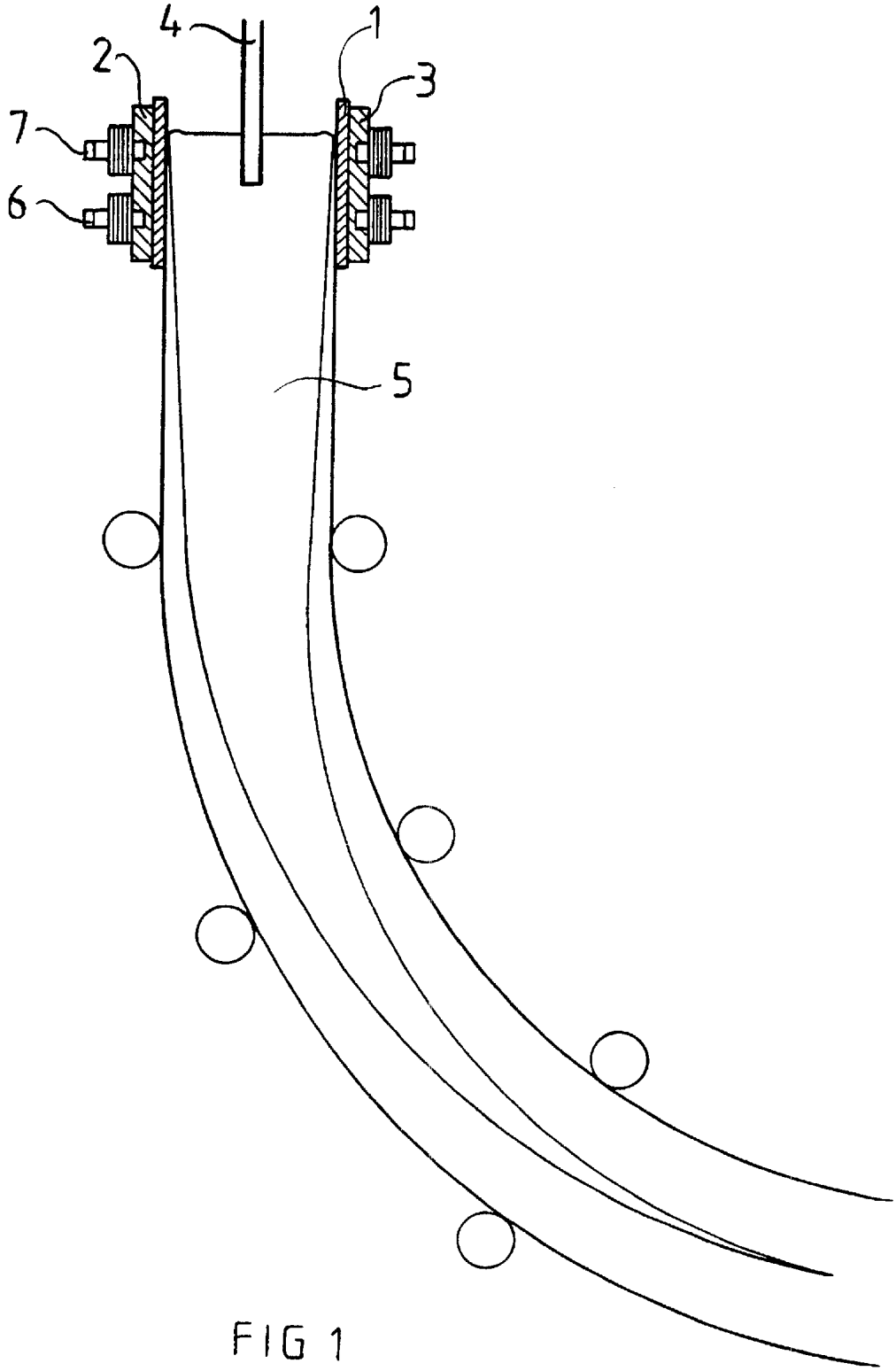
FIG. 1 is a schematic cross section view from one side of a device for continuous casting of metals.
Figure 2:
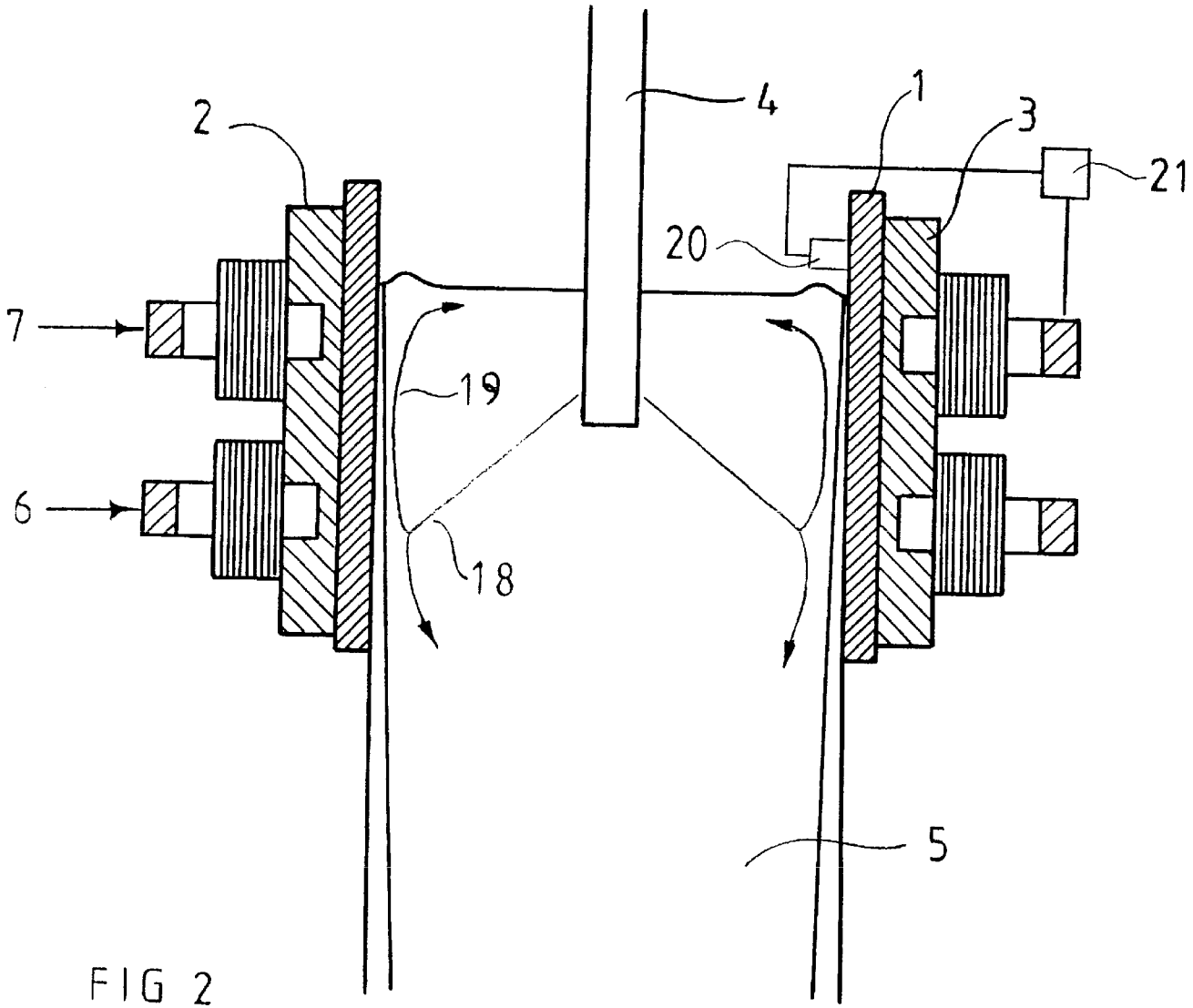
FIG. 2 is a cross section view from the side of an upper part of the device according to FIG. 1.
Figure 3:
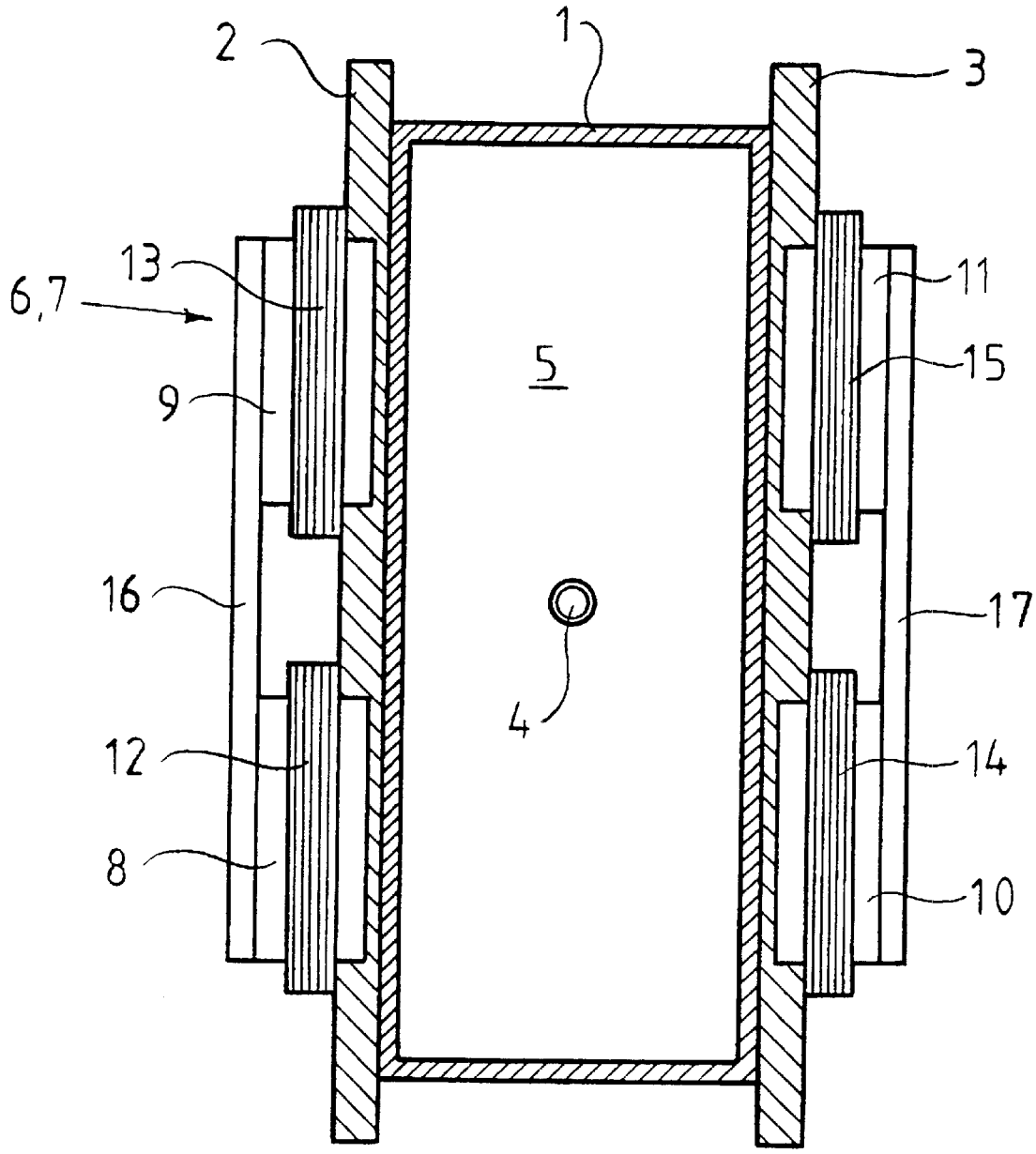
FIG. 3 is a view from above of the device according to FIGS. 1 and 2.

FIGS. 1–3 show a device for continuous casting of metals, such as for example steel. The device comprises a mould, which defines a cylinder composed of four opposite walls. The mould is preferably made of a copper alloy or any other alloy having a suitable thermal conductivity and thermal resistance. Outside at least two opposite walls of the mould 1 members 2, 3 for cooling said walls are arranged. The cooling members 2, 3 may comprise any type of supporting frame, through which cooling channels for transport of the cooling medium, such as water, may be arranged. Such channels may possibly be arranged so that they allow the cooling medium to flow directly towards the external surfaces of said walls for cooling thereof.

The device also comprises a member 4, here a so-called "submerged entry nozzle, SEN", through which a liquid metal is supplied from a container not shown to the space defined by the mould. During the casting sequence the mould 1 is filled with metal. This metal is present mainly as a liquid metal, but along the interface to the mould 1 it defines a solidified or partially solidified outer layer, a so called skin, which grows gradually in thickness in the casting direction. The mould 1 is then adapted to carry out a substantially vertical oscillating movement while a casting string 5 consisting of liquid metal and the solidified outer layer surrounding this successively is fed out from one end of the mould 1.

The member 4 extends from above into the liquid metal present in the mould 1. Further liquid metal is supplied to the mould 1 through the member 4. The liquid metal flowing into the liquid metal in the mould 1 from the member 4 generates a primary flow, which is illustrated through the arrows 18, and a secondary flow, illustrated through the arrows 19, in the liquid metal already present in the casting mould 1. These natural oscillations are of the type wide-band spectrum. Since resonance phenomena occur as a consequence of these oscillations in the liquid metal, it may result in the transport of large bubbles, which contain gases or slag, downwardly into the casting string 5. As a result thereof enclosures, bubbles or argon containing enclosures and slag from the meniscus are present in the finally entirely solidified casting string 5. Velocity variations caused by the oscillating flow in the mould may give rise to pressure variations at the meniscus and height variations of the meniscus. This leads at high meniscus velocities to slag drawdown, an uneven slag thickness, an uneven skin thickness and the risk of crack formation. Furthermore, the oscillating flow results in an asymmetric velocity in the mould. The velocity at one narrow side may in certain positions be substantially higher than at the other narrow side. This results in a powerful transport downwardly of the enclosures and gas bubbles accompanied by a decreased slag quality.

For avoiding the problem mentioned above the device comprises a first set of magnet members 6, which are adapted to apply or generate a varying magnetic field across the liquid metal in the mould 1, i.e. transversal to the casting direction. The magnet members are according to a preferred embodiment adapted to irregularly, e.g. at random times but within given limits in the time, generate a varying magnetic field with a random amplitude within at least a predetermined amplitude range.

The magnet members may also advantageously be designed to generate the magnetic field in such a way that it has a frequency varying randomly, in which also the frequency is within at least a predetermined range. The lowest frequency, or at least the average frequency, should however, exceed 1 Hz, and preferably exceed 10 Hz. As an alternative, the magnet members may be arranged in such a way that they generate a magnetic field with a determined amplitude and frequency, for example a magnetic field which may be described by a square wave or a sinus-shaped wave, such as in FIGS. 6 and 7. The device may also comprise means (not shown) for activating the magnet members to generate said magnetic field at predetermined periods. Said activating means may then comprise means 20 for detecting a certain condition or for predicting the appearance of a certain condition by modelling/calculation, for example a certain movement in the liquid metal or of a member 4, in which activation of the magnet members is to be carried out and means 21 for controlling said activation. A device adapting the disturbance by natural oscillations existing thereof to the conditions prevailing for the moment in the liquid metal is thereby obtained.

The device also comprises a second set 7 of magnet members. This second set 7 is arranged closer to the upper surface of the liquid metal in the mould 1 than the first set 6 and is arranged substantially on the same level as that part of the member 4 that projects down into the liquid metal. The first set 6 of magnet members is arranged immediately after the member 4 as seen in the casting direction, in this case below the opening or openings of the member 4 for letting the liquid metal out. Also the second set 7 of magnet members is advantageously arranged to generate a magnetic field similar to any of the magnetic fields described above and generated by the first set 6 of the magnet members.

FIG. 3 shows a set of magnet members 6 or 7, seen from above. As appears from FIG. 3, the set 6, 7 comprises two couples of magnet cores, preferably iron cores 8, 9 and 10, 11. On each of the said cores 8–11 a winding 12–15 of an electric conductor is arranged. Said windings 12–15 are fed from one or several (not shown) current sources with current, preferably direct current varying in time, for generating a magnetic field extending across, i.e. through, the liquid metal in the mould 1. The cores 8, 9 and 10, 11 of the respective couple are connected to each other through yokes or leg members 16, 17. The magnet cores and the windings are arranged in a way known per se, as appears from FIG. 3, but they could of course be arranged in another way and possibly comprise more or fewer individual magnet cores and windings arranged thereon. Thus, second arrangement of yoke members 16, 17 and magnet cores 8–11 with respect to each other is possible, for example for generating the magnetic field on several levels in the casting direction, or for generating one or several magnetic fields extending in the casting direction.

Figure 4:
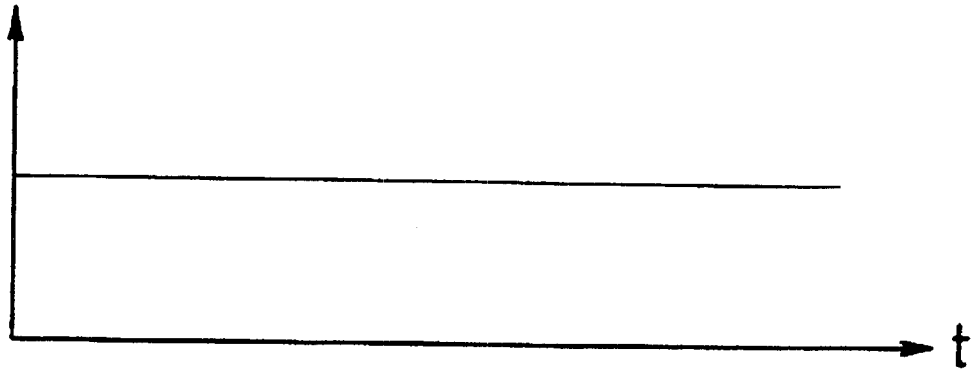
FIG. 4 is a diagram showing a static magnetic field, or the direct current used for generating this field, on which a varying magnetic field is superposed.
Figure 5:
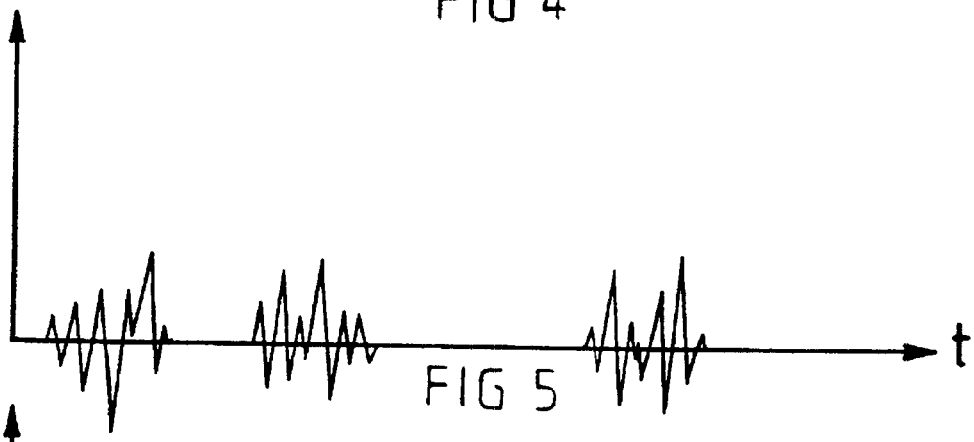
FIGS. 5–7 are diagrams showing how a varying magnetic field, or the current varying said magnetic field, may be varied in the time according to different embodiments of the invention
Figure 6:
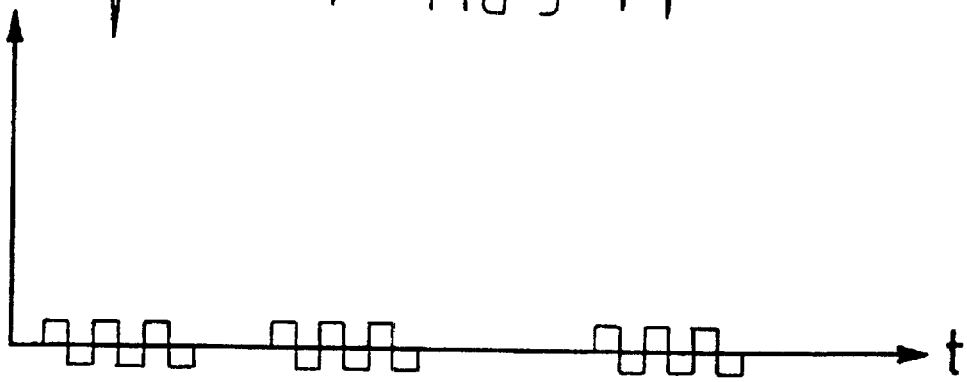
Figure 7:
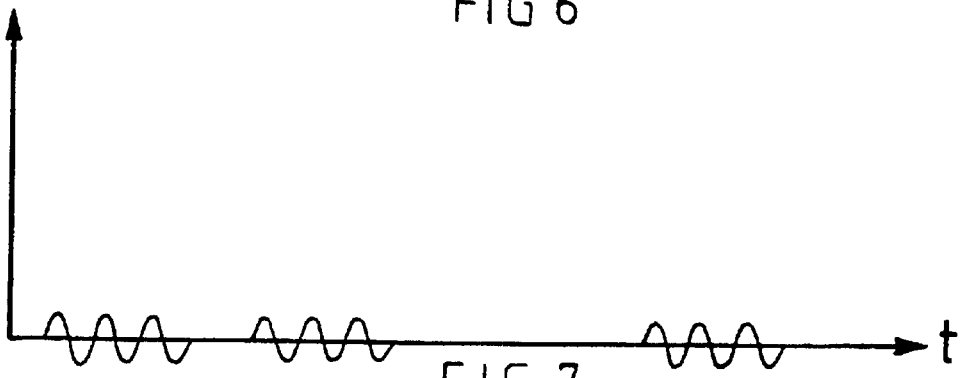

According to prior art the magnet members have, arranged in the way appearing from FIGS. 1–3, been adapted to generate a generally static or periodic low-frequency ($f<1$ Hz) magnetic field across the liquid metal in the mould 1 in order to influence the primary and secondary flows described earlier in the liquid metal. Problems associated with said flows and described within the prior art are thereby solved. The sets 6, 7 of magnet members in the device according to the present invention are preferably also arranged to generate a substantially static magnetic field across the liquid metal in the mould 1 to influence the primary and secondary flows in a way favourable for the casting sequence. The different types of varying magnetic fields generated by the sets of magnet members 6, 7 are superposed onto said static magnetic field. The static magnetic field is shown in FIG. 4, while different types of varying magnetic fields, which may be superposed onto the static magnetic field, are shown in FIG. 5–7. The varying magnetic fields shown in FIGS. 5–7 are examples of how such magnetic fields may be generated according to the invention. The magnetic field according to FIG. 5 is generated at random times, has a stochastic amplitude within a given range, as well as a stochastic frequency within a given range. The magnetic fields according to FIG. 6 have, however, a given constant amplitude and frequency, which is also the case for the magnetic field described through FIG. 7. The diagrams shown in FIGS. 4–7 may also be described to show the current applied to the conductor windings 12–15 for generating said magnetic fields.

The frequency of the varying magnetic field is preferably higher than the frequency of the oscillation or the oscillations of the liquid metal to be disturbed by said magnetic field. The frequency of the magnetic field is preferably in the order of $10–10^3$ times higher than the frequency of said oscillations. The oscillations have a frequency in the order of 0.01–10 Hz. Since the frequency, or the average frequency, of the magnetic field is lower or of substantially the same size as said frequencies, it should be generated so that it is in opposite phase, or at least not entirely in phase with said oscillations.

In some cases, for example when natural oscillations having different amplitudes and frequencies are present in different parts of the liquid metal, the magnet members are advantageously adapted to generate one or several magnetic fields adapted to the specific oscillations conditions prevailing in the different parts of the liquid metal where exactly these magnetic fields propagate.

Figure 8:
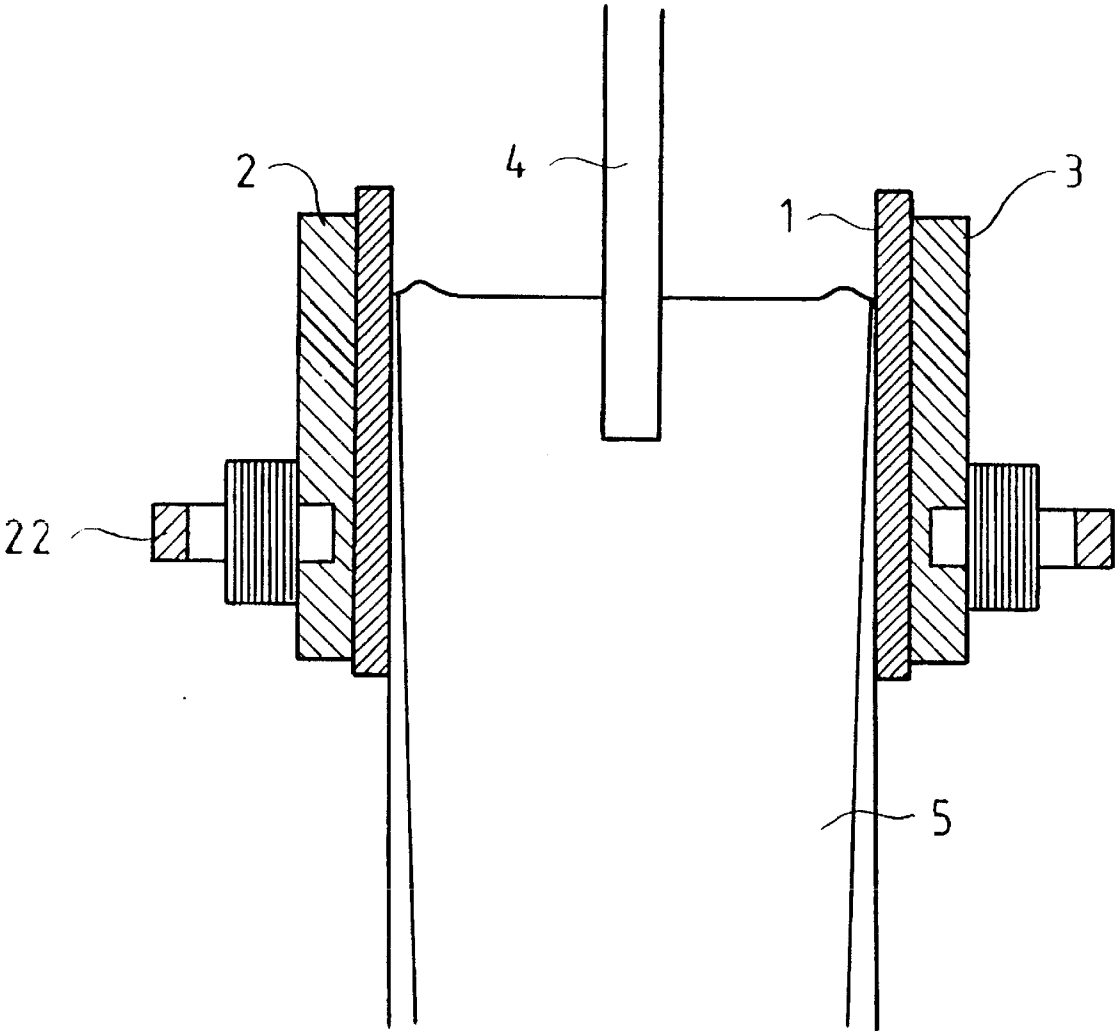
FIG. 8 is a schematic lateral cross section view showing a device having magnet members at only one level.

FIG. 8 shows an alternative embodiment of the device according to the invention, where only one set of magnet members 22 is arranged at only one level at the mould in the casting direction. The set 22 is arranged in a region downstream of the opening/openings of the member 4.

A plurality of modifications of the device according to the invention and the method according to the invention will of course be apparent to a man skilled in the art while these are still within the scope of protection of the present invention, such as this is defined in the appended claims.

It is important to note that the magnetic field is fixed or stationary, i.e. it does not move and thereby agitate the liquid metal, which is the case for conventional agitators.

It is to be understood that the member 4 may be arranged in such a way that it does not project into the liquid metal in the mould, by which a free tap jet reaches the liquid metal.

It should also be noticed that the natural oscillations, which the invention aims to damp or disturb, comprise large movements within the liquid metal, where large portions in the liquid metal with certain flowing conditions are displaced mutually more or less periodically, whereby unfavourable casting conditions occur.

The varying magnetic field is preferably superposed onto a substantially static magnetic field normally being constantly applied to the liquid metal. By applying the varying magnetic field in pulses or periodically the strength of the static field may be reduced somewhat at least periodically, while establishing desired casting conditions. This may be an advantage with respect to the flow topology as well as the energy consumption.

What is claimed is:

1. A method for continuous casting of metals, in which liquid metal is supplied as a jet to a mould which already contains a further liquid metal, wherein:

a magnetic field varying with time and being substantially stationary is applied by magnet members to the liquid metal in the mould for preventing natural oscillations of the liquid metal from being generated, and the varying magnetic field is applied at irregular intervals during the casting sequence.

2. A method according to claim 1, wherein a substantially static magnetic field is applied to the liquid metal, and said varying magnetic field is superposed onto the substantially static magnetic field.

3. A method according to claim 1, wherein the application of the varying magnetic field is carried out periodically.

4. A method according to claim 3, wherein said periodic application is carried out at predetermined times.

5. A method according to claim 1, wherein said irregular application is carried out at random times.

6. A method according to claim 1, wherein the application is carried out upon detection of a predetermined condition in the liquid metal.

7. A method according to claim 1, wherein the varying magnetic filed is provided with stochastically varying amplitude.

8. A method according to claim 1, wherein the varying magnetic field has a constant peak of height.

9. A method according to claim 1, wherein the varying of the magnetic field defines a sinus-shaped wave.

10. A method according to claim 1, wherein the varying magnetic field is provided with a frequency which is in an order of $10–10^3$ times higher than the frequency of the oscillation or oscillations which it is intended to disturb.

11. A method for continuous casting of metals, in which liquid metal is supplied as a jet to a mould which already contains a further liquid metal, wherein:

a magnetic field varying with time and being substantially stationary is applied by magnet members to the liquid metal in the mould for preventing natural oscillations of the liquid metal from being generated, and the varying magnetic field is provided with stochastically varying amplitude.

* * * * *